US006659058B2

(12) United States Patent
Ozeki

(10) Patent No.: US 6,659,058 B2
(45) Date of Patent: Dec. 9, 2003

(54) INTAKE SYSTEM OF A V-TYPE ENGINE

(75) Inventor: Hisashi Ozeki, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/176,347

(22) Filed: Jun. 20, 2002

(65) Prior Publication Data

US 2003/0019457 A1 Jan. 30, 2003

(30) Foreign Application Priority Data

Jul. 25, 2001 (JP) ..... 2001-223962

(51) Int. Cl.[7] ..... F02M 35/10
(52) U.S. Cl. ..... 123/184.34; 123/184.31
(58) Field of Search ..... 123/184.31, 184.34

(56) References Cited

U.S. PATENT DOCUMENTS

| | | | |
|---|---|---|---|
| 4,784,091 | A | 11/1988 | Okada et al. |
| 5,127,370 | A | 7/1992 | Suzuki et al. |
| 6,055,958 | A | 5/2000 | Aoyama et al. |

FOREIGN PATENT DOCUMENTS

| | | | |
|---|---|---|---|
| JP | 59565 | | 5/1982 |
| JP | 62237028 | A2 | 10/1987 |
| JP | 63215822 | A2 | 9/1988 |
| JP | 3271558 | A2 | 12/1991 |
| JP | 7229424 | A2 | 8/1995 |
| JP | 08319813 | A2 | 12/1996 |
| JP | 11294171 | A2 | 10/1999 |
| JP | 2000186640 | A2 | 7/2000 |

*Primary Examiner*—Noah P. Kamen
(74) *Attorney, Agent, or Firm*—Flynn, Thiel, Boutell & Tanis, P.C.

(57) ABSTRACT

A V-type engine having an intake system structure formed of a surge tank and intake pipes. The intake system structure is divided into upper and lower blocks by a horizontal dividing surface positioned below the surge tank. The upper block includes the surge tank, and first and second upper pipe parts of the intake pipes. The lower block includes first and second lower pipe parts of the intake pipes. First and second seal parts surround the intake passages on the dividing surface toward the upper block. First and second straight inner sealing surfaces are arranged at the portion where the seal parts extend inwardly of the engine banks. Only these straight inner sealing surfaces are positioned below the surge tank.

4 Claims, 5 Drawing Sheets

INTAKE SYSTEM OF A V-TYPE ENGINE

FIELD OF THE INVENTION

This invention relates to an intake system of a V-type combustion engine, and more particularly to an intake system of a V-type engine having a surge tank above and between engine banks of the V-type engine.

BACKGROUND OF THE INVENTION

An engine may comprise cylinders disposed in a straight line, opposed cylinders, or cylinders in a V-shaped form.

An intake system of the type for a V-type engine comprises, as shown in FIG. 8, first and second surge tanks 108A, 108B, first and second intake pipes 114A, 114B, and first and second fuel delivery pipes 118A, 118B. The surge tanks 108 are separated from one another, and are disposed above a space 106 defined between a first engine bank 104A (a right bank) and a second engine bank 104B (a left bank) of the V-type engine 102. The intake pipes 114A, 114B branch and extend from sides of the surge tanks 108A, 108B and intersect (i.e., cross) below the surge tanks 108, and then connect to first and second cylinder heads 110A, 110B of the engine banks 104A, 104B respectively. The fuel delivery pipes 118A, 118B are positioned in first and second spaces 116A, 116B below the surge tanks 108A, 108B and above the intake pipes 114A, 114B.

Also, another intake system of a V-type engine is divided into upper and lower block members, wherein the upper block includes a surge tank and first and second upper pipe parts of intake pipes, and the lower block includes first and second lower pipe parts of the intake pipes.

Further, such an intake system of the V-type engine is disclosed in e.g. Japanese Patent Laid-Open Official Gazette No. 62-237028, Japanese Patent Laid-Open Official Gazette No. 11-294171, and Japanese Patent Laid-Open Official Gazette No. 59-565.

The intake system disclosed in Japanese Patent Laid-Open Official Gazette No. 62-237028 has a constitution in which intake passages are connected to intake ports on the inward sides of banks of cylinder heads, and are positioned in recesses, which is formed in cylinder head covers, correspondingly to cylinder head bearings of camshafts in the other bank. Also, the intake system disclosed in Japanese Patent Laid-Open Official Gazette No. 11-294171 has volume chambers and resonance passage parts formed integrally in a collector. Further, the intake system disclosed in Japanese Patent Laid-Open Official Gazette No. 59-565 includes a supercharge high pressure pipe type intake manifold which is arranged in a relatively wide space between cylinders of the V-type engine. A space for adjacent outer engine elements is secured to permit smaller composition.

However, the conventional intake system of the V-type engine has inconvenience when the intake system is divided into an upper block which includes the surge tank and the upper pipe parts of the intake pipes, and a lower block, which includes the lower pipe parts of the intake pipes. That is, seal parts of the intake pipes enter inwardly into the surge tank, and therefore coupling bolts for coupling the upper and lower blocks are also required on the inner side of the surge tank to provide sealability of the intake pipes. This requirement results in complicated constitution of the system, difficulty of assembly of delivery pipes, and a heavier system.

In order to obviate the above inconveniences, the present invention provides an intake system of a V-type engine having a surge tank above and between first and second engine banks of the V-type engine. First and second intake pipes form therein first and second intake passages, and branch and extend from both sides of the surge tank to cross below the surge tank to connect to the engine banks. In first and second spaces which are defined by a lower part of the surge tank and upper parts of the intake pipes, first and second delivery pipes are disposed. An intake system structure is formed by the surge tank and the intake pipes. The intake system structure is divided into upper and lower blocks by a horizontal dividing surface positioned below the surge tank. The upper block includes the surge tank, and first and second upper pipe parts of the intake pipes. The lower block includes first and second lower pipe parts of the intake pipes. First and second seal parts surround the intake passages on the dividing surface toward the upper block. First and second straight inner sealing surfaces are arranged at the portion where the seal parts extend internally toward the engine banks. Only these straight inner sealing surfaces are positioned below the surge tank.

According to the present invention, the intake system structure is thus divided into upper and lower blocks, so that installation of fuel delivery pipes below the surge tank can be made easier. Also, the inner seal parts of the intake pipes are formed to be straight, and only these parts are positioned below the surge tank, so that the seal parts on the dividing surface of the intake pipes do not protrude inwardly toward the surge tank. Accordingly, the sealability of the intake pipes can be achieved without coupling bolts on the inner side of the surge tank, which permits easier composition and a lighter system.

DETAILED DESCRIPTION

The present invention will now be described in specific detail with reference to FIGS. 1 to 5 which illustrate a first embodiment of this invention.

Figure 1:
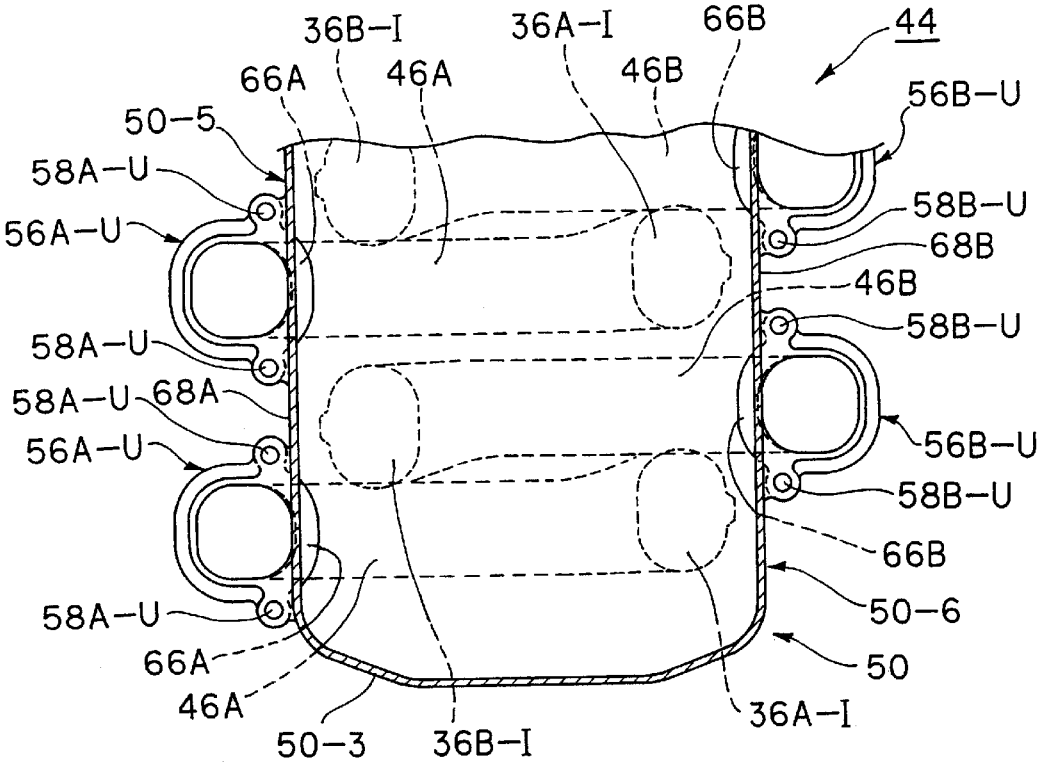
FIG. 1 is a cross-sectional view of an intake system structure according to a first embodiment and taken along line I—I in FIG. 2.
Figure 2:
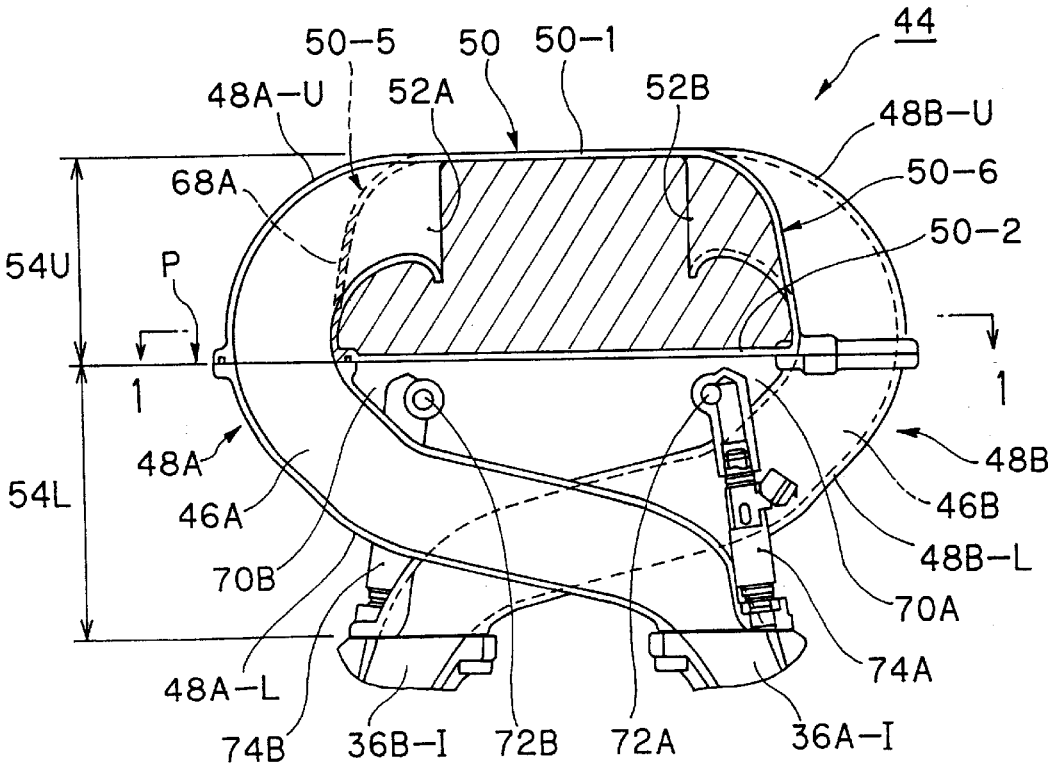
FIG. 2 is a front view of the intake system structure.
Figure 3:
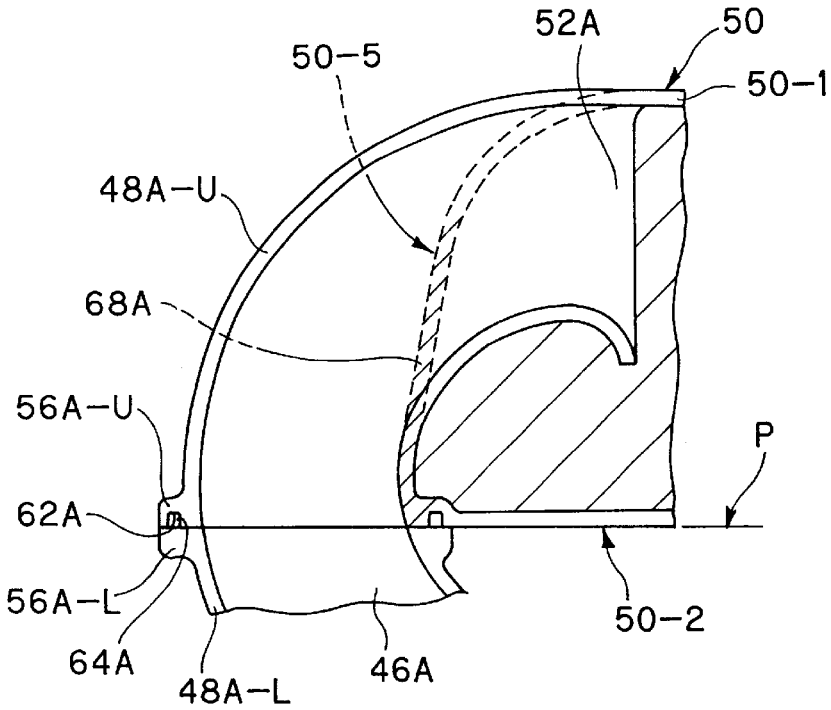
FIG. 3 is an enlarged view of a main part of the intake structure shown in FIG. 2.
Figure 4:
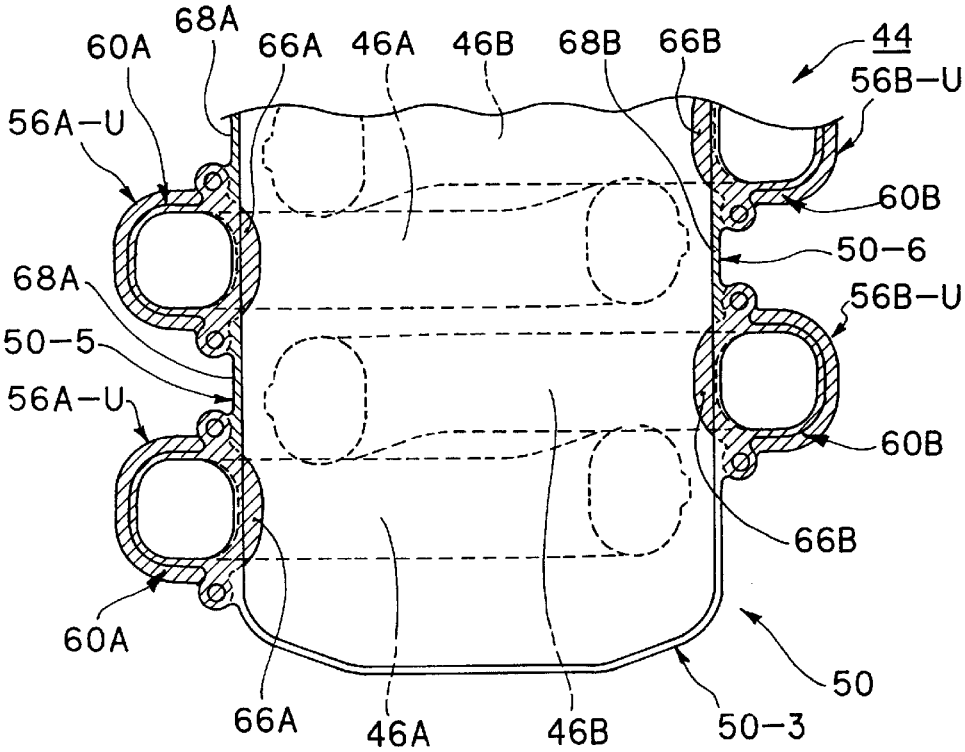
FIG. 4 is a cross-sectional view showing a seal part of the intake system structure.
Figure 5:
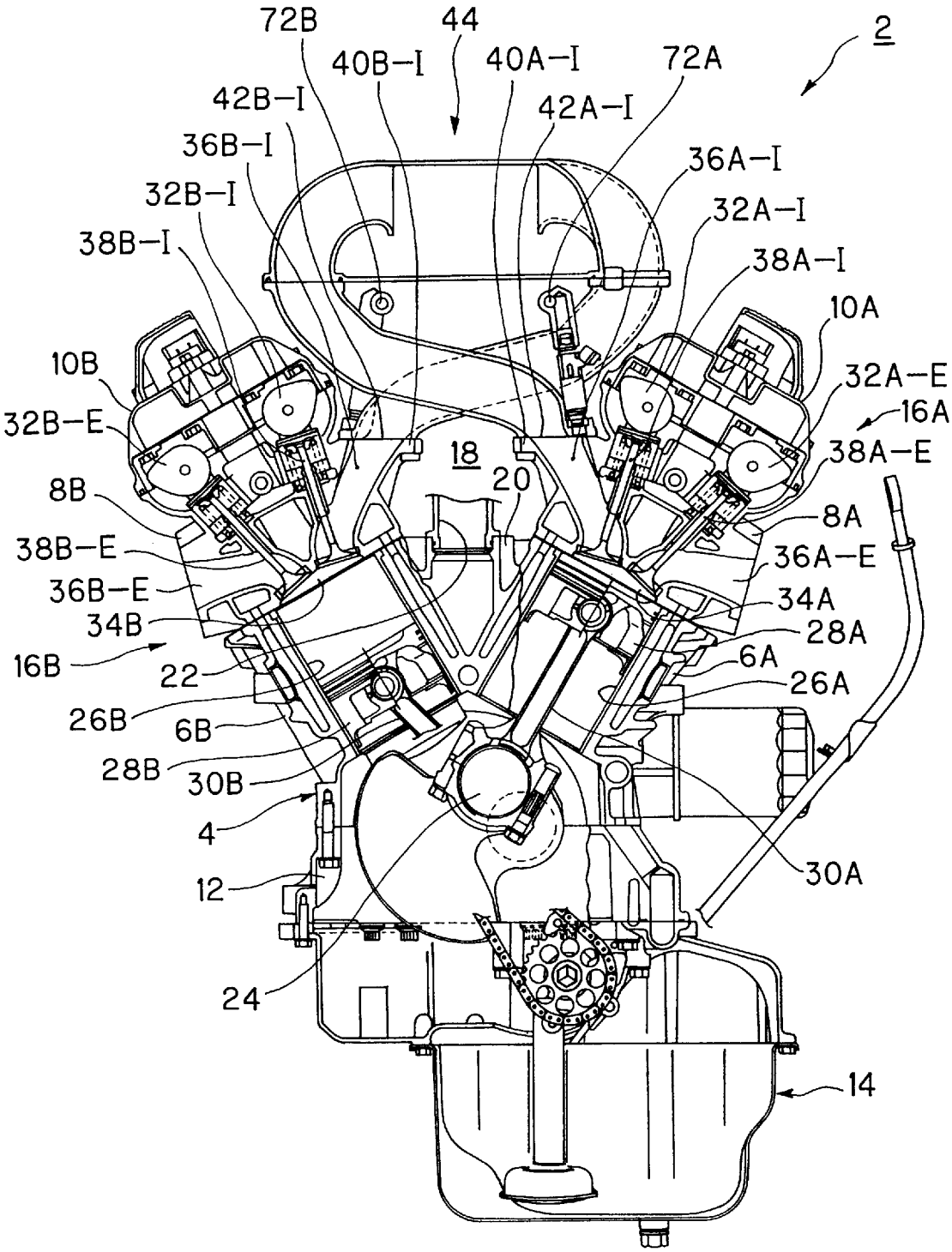
FIG. 5 is a cross-sectional view showing a V-type engine according to the first embodiment.

FIG. 5 shows a multi-cylinder V-type engine 2. This V-type engine 2 has first and second cylinder heads 8A, 8B on V-shaped first and second cylinder banks 6A, 6B as defined on the upper part of cylinder block 4. First and second cylinder head covers 10A, 10B are mounted on the cylinder heads 8A, 8B. A bearing cap 12 is attached at its top to the lower part of the cylinder block 4 and at its bottom to an oil pan 14.

In this V-type engine 2, a first engine bank (a left bank) 16A is defined by the first cylinder bank 6A, the first cylinder head 8A, and the first cylinder head cover 10A. A second engine bank (a right bank) 16B is defined by the second cylinder bank 6B, the second cylinder head 8B, and the second cylinder head cover 10B. A V-shaped space 18 is defined between the engine banks 16A, 16B.

A horizontal upper wall 20 of the cylinder block is formed between the cylinder banks 8A, 8B and is provided with a cooling water discharge pipe 22 extending from above in the space 18 toward a crankshaft 24.

The rotatably supported crankshaft 24 is disposed between the cylinder blocks 4 and the bearing cap 12.

Each first cylinder 26A is formed in the cylinder bank 6A and has a first slidable piston 28A which is connected to a smaller end of a first connecting rod 30A. The connecting rod 30A has a larger end connected to the crankshaft 24. Similarly, each second cylinder 26B is formed in the cylinder bank 6B and has a second slidable piston 28B which is connected to a smaller end of a second connecting rod 30B. The connecting rod 30B has a larger end connected to the crankshaft 24.

A first inner intake camshaft 32A-I and a first outer exhaust camshaft 32A-E are rotatably supported in the upper part of the cylinder head 8A. A first combustion chamber 34A is formed in the lower part of the cylinder head 8A. A first inner intake port 36A-I, and a first outer exhaust port 36A-E are formed to connect to the combustion chamber 34A. First intake and exhaust valves 38A-I, 38A-E correspond to the intake and exhaust ports 36A-I, 36A-E. Similarly, second inner and outer intake camshafts 32B-I, 32B-E are rotatably supported in the upper part of the cylinder head 8B. A second combustion chamber 34B is formed in the lower part of the cylinder head 8B. A second inner intake port 36B-I and a second outer exhaust port 36B-E are formed to connect to the combustion chamber 34B. Second intake and exhaust valves 38B-I, 38B-E correspond to the intake and exhaust ports 36A-I, 36A-E.

A first intake port forming wall 40A-I toward the bank space 18, which forms the first intake port 36A-I, includes upper surface 42A-I of the first intake port as a horizontal plane. Similarly a second intake port forming wall 40B-I toward the bank space 18, which forms the second intake port 36B-I, includes upper surface 42B-I of the second intake port as a horizontal plane.

Also, in the V-type engine 2, an intake system structure 44 is disposed above the space 18 between the engine banks 16A, 16B.

This intake system structure 44 can be formed from material of, e.g., metal, casting, and resin. The structure 44 integrally comprises first and second intake pipes 48A, 48B which form therein first and second intake passages 46A, 46B, and a surge tank 50. The surge tank 50 is defined by upper and lower tank walls 50-1, 50-2, end tank walls 50-3, and side tank walls 50-5, 50-6, thereby forming a certain volume.

The first intake pipe 48A comprises a first upper pipe part 48A-U and a first bent lower pipe part 48A-L. The upper pipe part 48A-U includes a first intake port 52A inserted into the surge tank 50 from one side tank wall 50-5. Also, the second intake pipe 48A comprises first upper and lower pipe parts 48B-U, 48B-L. The upper pipe part 48B-U includes a second intake port 52B which is inserted into the surge tank 50 from the other side tank wall 50-6 The lower pipe parts 48A-L, 48B-L of the intake pipes 48A, 48B branch and extend from both sides of the surge tank to intersect (i.e., cross) below the surge tank 50 to connect to the upper surfaces 42A-I, 42B-I of the cylinder heads 8A, 8B in the engine banks 16A, 16B.

The intake system structure 44 is divided into upper and lower blocks 54U, 54L by a horizontal dividing surface "P" below the surge tank 50. The surface "P" is generally at the level of the bottom wall 50-2 of the surge tank in the preferred embodiment. The upper block (an upper intake manifold) 54U is integrally formed of the surge tank 50 and upper intake pipe parts 48A-U, 48B-U. The lower block (a lower intake manifold) 54L is formed of lower pipe parts 48A-L, 48B-L.

A first upper connecting flange 56A-U is formed on the side of the upper pipe part 48A-U in the upper block 54U toward the dividing surface "P". The upper connecting flange 56A-U has therein a pair of first upper block coupling holes 58A-U, 58A-U along the tank wall 50-5. Similarly, a second upper connecting flange 56B-U is formed on the side of the upper pipe part 48B-U in the upper block 54U toward the dividing surface "P". The upper connecting flange 56B-U has therein a pair of first upper block coupling holes 58B-U, 58B-U along the tank wall 50-6. Coupling bolts (not shown) are inserted into the coupling holes 58A-U, 58A-U, 58B-U, 58B-U.

In addition, a first lower connecting flange 56A-L corresponding to the upper connecting flange 56A-U is formed on the lower pipe parts 48A-L of the lower block 54L. A second lower connecting flange 56B-L is formed on the lower pipe part 48B-L of the lower block 54L.

First and second seal parts 60A, 60B surrounding the intake passages 46A, 46B are formed on the side of the upper connecting flange 56A-U, 56B of the upper block 54U toward the dividing surface "P". A groove 62A for sealing is formed in the seal part 60A as show in FIGS. 2 and 3, and an O-ring 64A as a sealing material is disposed therein. Similarly, an O-ring (not shown) is disposed in the seal part 60B.

First and second straight inner seal surfaces 66A, 66B of the seal parts 60A, 60B are formed at a position where the seal parts extend inwardly of the respective engine banks 16A, 16B.

The straight inner seal surfaces 66A, 66B are arranged such that only these surfaces are disposed below the surge tank 50 and inserted thereinto. The surfaces 66A, 66B are aligned to extend generally along the side walls 50-5, 50-6 of the surge tank 50.

In the upper block 54U, first and second planar walls 68A, 68B at the back of the straight inner seal surfaces 66A, 66B connect the space between adjacent inner seal surfaces 66A, 66B with the surge tank 50. The walls 68A, 68B are formed to be generally in line with the inner seal surfaces 66A, 66B.

These planar walls 68A, 68B define a part of the side tank walls 50-5, 50-6 as an inner space forming wall of the surge tank 50.

First and second delivery pipes 72A, 72B are disposed in spaces 70A, 70B which are defined by the lower part of the surge tank 50 and the lower part of the intake pipes 48A, 48B. The delivery pipes 72A, 72B are connected to first and second fuel injection valves 74A, 74B which are fixed to the lower pipe parts 48A-L, 48B-L.

The operation of the above embodiment will now be briefly described.

The seal parts 60A, 60B which surround the intake passages 46A, 46B are disposed on the upper connecting flanges 56A-U, 56B-U on the side toward the dividing surface "P". The straight inner seal surfaces 66A, 66B of the seal parts 60A, 60B are formed at a position where the seal parts extend inwardly of the engine banks 16A, 16B.

Further, only these inner seal surfaces 66*a,* 66B are projected inwardly so as to be positioned below the surge tank 50.

The intake system structure 44 is divided into the upper and lower blocks 54U, 54L at the lower surface of the surge tank 50, so that the upper block 54U can be removed from the lower block 54L in case of installation of the delivery pipes 72A, 72B. Accordingly, the delivery pipes 72A, 72B below the surge tank 50 can be easily mounted to improve installation. In addition, the seal parts toward the inner side of the intake pipes 48A, 48B are formed to be straight, and only these parts project inwardly below the surge tank 50. Accordingly, the sealability of the intake pipes 48A, 48B can be attained without the coupling bolts going into the interior of the surge tank 50, so that the construction can be made simpler and of reduced weight.

Also, in the upper block 54U, the planar walls 68A, 68B are disposed at the back of the straight inner seal surfaces 66A, 66B, and these walls communicate with adjacent inner seal surfaces 66A, 66B which are part of the surge tank 50. The planar walls 68A, 68B are formed in line with the inner seal surfaces 66A, 66B. Accordingly, the connection between the adjacent inner seal surfaces 66A and between the adjacent inner seal surfaces 66B can be improved. This prevents the seal surfaces inside of the surge tank 50 from deforming so as to improve the sealability.

Further, the planar walls 68A, 68B are a part of the space forming walls of the surge tank 50. Accordingly, the strengthening planar walls 68A, 68B between the seal parts 60A, 60B and the walls forming the inner space of the surge tank 50 can be shared, so that the intake system structure 44 can be made compactly and of reduced weight.

Figure 6:
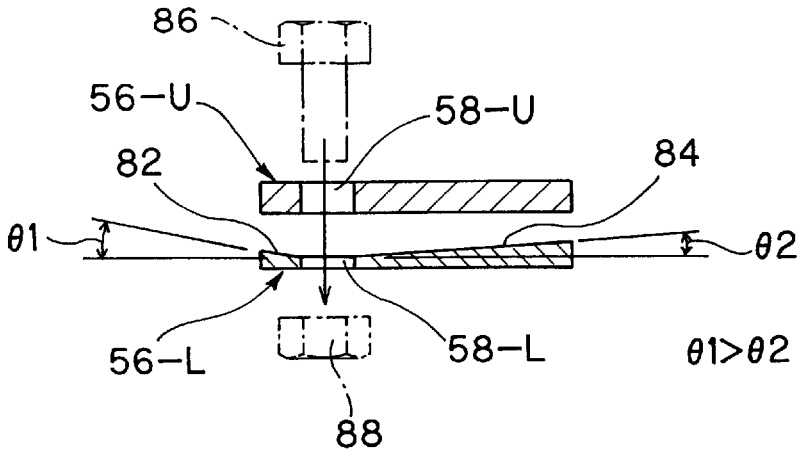
FIG. 6 is a cross-sectional view showing upper and lower connecting flanges according to a second embodiment.

FIG. 6 shows a specific constitution of the present invention as a second embodiment of the invention. In this second embodiment, the same functional parts are designated by the same reference numerals with respect to the first embodiment.

The second embodiment is characterized in that upper and lower block coupling holes 58-U, 58-L are formed in the upper and lower connecting flanges 56-U, 56-L respectively. Also, for example, on the seal surface of the lower connecting flange 56-L, a first inclined surface 82 is formed at an angle θ1 in the vicinity of the lower block coupling hole 58-L. A second inclined surface 84 is formed at an angle θ2 smaller than θ1 away from the lower coupling hole 58-L toward the inner seal surface 66. The upper and lower connecting flanges 56-U, 56-L are secured by threading the coupling bolt 86 into the upper and lower holes 58-U, 58-L and screwing a coupling nut 88 onto the bolt 86.

According to the second embodiment, clamping of the upper and lower connecting flanges 56-U, 56-L by the bolt 86 and nut 88 causes the lower flange 56-L to bend in the vicinity of the lower hole 58-L. The lower flange 56-L can be strongly joined to the upper flange 56-U at the portion of the inner seal surface 66 away from the lower holes 58-L, so that the sealability of the upper and lower flanges 56-U, 56-L can be improved by this simple constitution.

Figure 7:
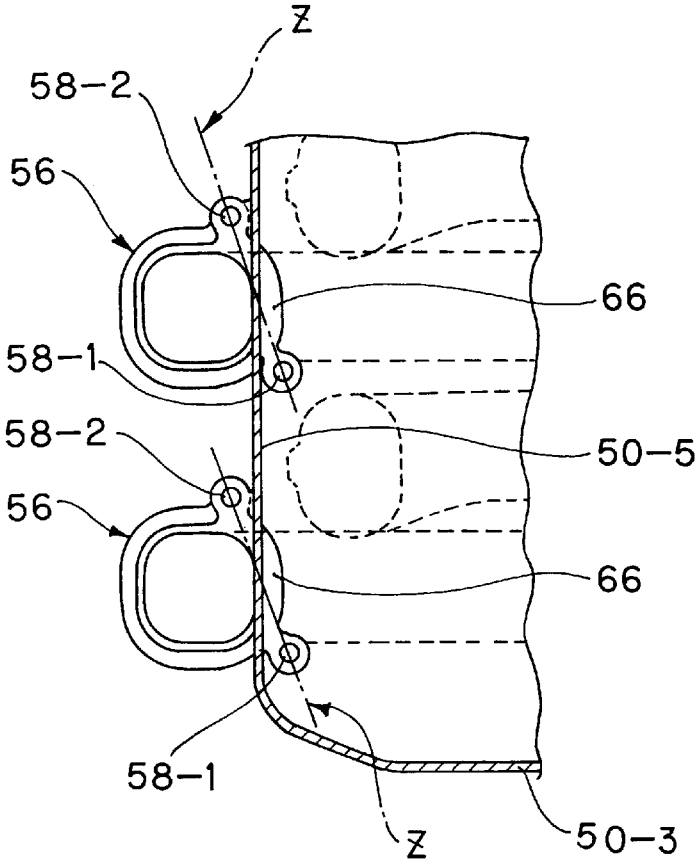
FIG. 7 is a cross-sectional view of the intake system structure according to a third embodiment.
Figure 8:
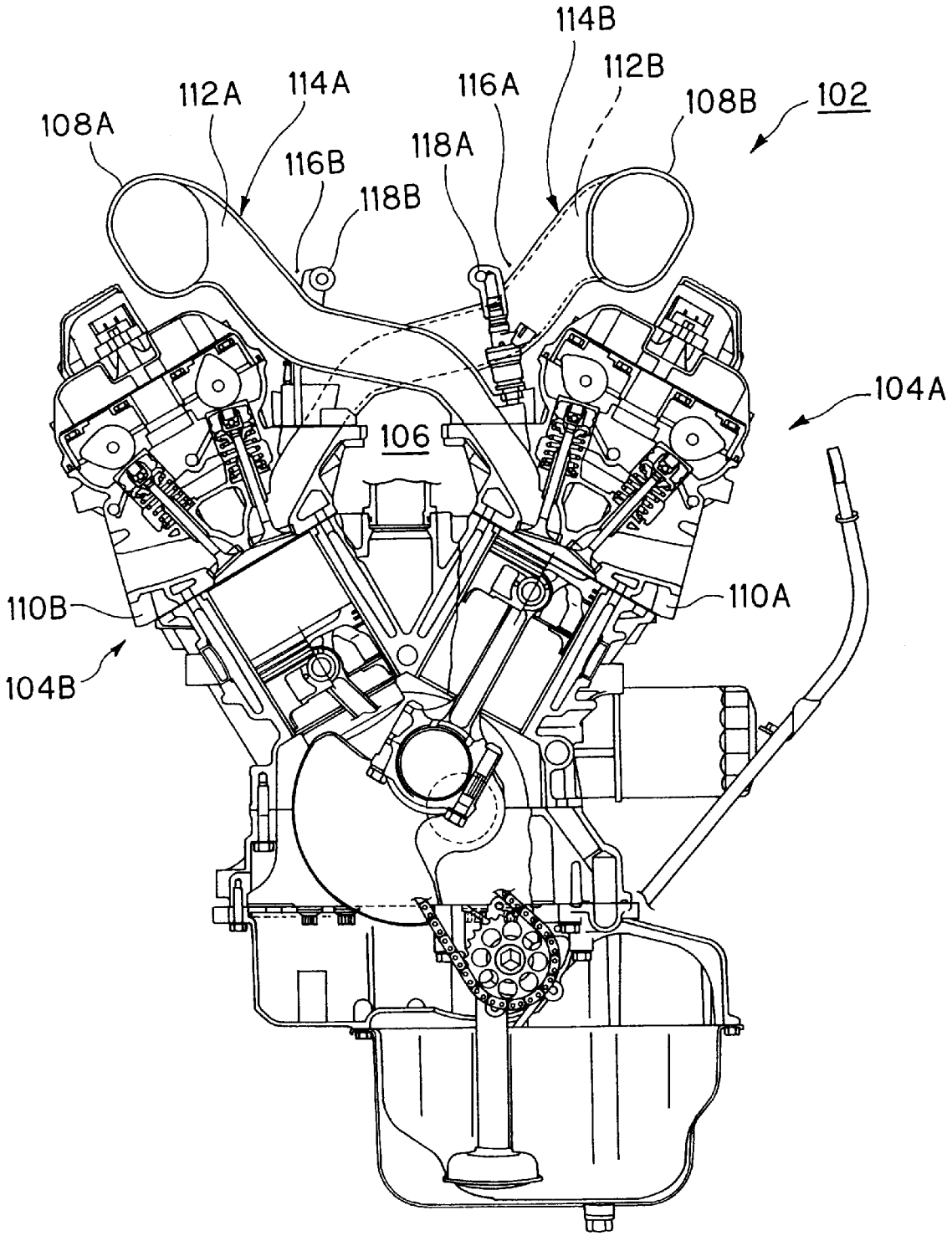
FIG. 8 PRIOR ART
FIG. 8 is a cross-sectional view of a conventional V-type engine.

FIG. 7 shows a specific constitution of the present invention as a third embodiment of the invention.

The third embodiment is characterized in that first and second block coupling holes 58-1, 58-2 are formed in the connecting flange 56, and are arranged to be on the line "Z" which intersects the inner seal surface 66. The block coupling hole 58-1 is placed, e.g., inside the tank wall 50-5 of the surge tank 50, and the block coupling hole 58-2 is placed outside the tank wall 50-5.

According to the third embodiment, coupling of the upper and lower blocks 54U, 54L improves the sealability of the inner seal surface 66, since the diagonal sealing force between inner and outer surfaces of tank wall 50-5 is applied to the inner seal surface 66.

As is clear from the above detailed description, according to the present invention, in a V-type engine, an intake system structure is formed of the surge tank and the intake pipes. The intake system structure is divided into upper and lower blocks by a horizontal dividing surface positioned below the surge tank. The upper block includes the surge tank, and first and second upper pipe parts of the intake pipes. The lower block includes first and second lower pipe parts of the intake pipes. First and second seal parts surround the intake passages on the dividing surface toward the upper block. First and second straight inner sealing surfaces are arranged at the portion where the seal parts extend internally of the engine banks. Only these straight inner sealing surfaces are positioned below the surge tank. Accordingly, the intake system structure is divided into upper and lower blocks so that installation of fuel delivery pipes below the surge tank can be made easier. Also, the inner seal parts of the intake pipes are formed to be straight, and only these parts are positioned below the surge tank, so that the seal parts on the dividing surface of the intake pipes do not protrude inwardly toward the surge tank. Accordingly, the sealability of the intake pipes can be achieved without the coupling bolts on the inner side of the surge tank, which permits easier composition and a lighter system.

Although particular preferred embodiments of the invention have been disclosed in detail for illustrative purposes, it will be recognized that variations or modifications of the disclosed apparatus, including the rearrangement of parts, lie within the scope of the present invention.

What is claimed:

1. An intake system of a V-type engine having first and second engine banks, comprising:

a surge tank above and between said first and second engine banks of said V-type engine;

first and second intake pipes forming therein first and second intake passages which respectively extend from opposite sides of said surge tank and cross below said surge tank and respectively connect to said first and second engine banks;

first and second delivery pipes in first and second spaces respectively defined by a lower part of said surge tank and lower parts of said intake pipes;

said intake system comprising an intake system structure formed of said surge tank and said intake pipes, said intake system structure being divided into upper and lower blocks by a horizontal dividing surface positioned below said surge tank, said upper block including said surge tank and first and second upper pipe parts of said intake pipes, said lower block including first and second lower pipe parts of said intake pipes;

first and second seal parts respectively positioned adjacent opposite sides of the surge tank and surrounding said intake passages on the dividing surface and facing toward said upper block; and first and second substantially straight inner sealing surfaces respectively associated with the first and second seal parts where they extend inwardly away from the engine banks so that only said inner sealing surfaces are positioned directly below said surge tank.

2. An intake system of a V-type engine according to claim 1, wherein said upper block includes a planar wall which is disposed at the back of said straight inner sealing surfaces, and which connects the space between adjacent straight inner sealing surfaces with said surge tank, said planar wall being substantially aligned with said inner sealing surfaces.

3. An intake system of a V-type engine according to claim 2, wherein said planar wall is a part of a side wall of said surge tank.

4. An intake system of a V-type engine according to claim 1, wherein said horizontal dividing plane is located substantially coplanar with a bottom wall of said surge tank, said first and second seal parts comprising annular parts which are defined substantially at said dividing surface and surround the respective intake passage, said first and second seal parts being respectively positioned directly adjacent but exteriorly of opposite side walls of said surge tank, said inner sealing surfaces being defined where the respective seal parts substantially engage the side walls of the surge tank so that the sealing surfaces are positioned directly below and sealingly engage the bottom wall of the surge tank.

* * * * *